US008408404B2

(12) United States Patent
Miller et al.

(10) Patent No.: US 8,408,404 B2
(45) Date of Patent: Apr. 2, 2013

(54) SHELVING SYSTEM AND COLLAPSIBLE WORK BENCH

(76) Inventors: Patrick D. Miller, Circle Pines, MN (US); David C. Miller, Donnybrook, ND (US); Douglas D. Miller, Kenmare, ND (US)

( * ) Notice: Subject to any disclaimer, the term of this patent is extended or adjusted under 35 U.S.C. 154(b) by 223 days.

(21) Appl. No.: 13/033,273

(22) Filed: Feb. 23, 2011

(65) Prior Publication Data

US 2011/0204014 A1 Aug. 25, 2011

Related U.S. Application Data

(60) Provisional application No. 61/307,809, filed on Feb. 24, 2010.

(51) Int. Cl.

| | |
|---|---|
| ***A47F 5/08*** | (2006.01) |
| *A47F 5/00* | (2006.01) |
| *A47B 43/00* | (2006.01) |
| *A47B 9/00* | (2006.01) |
| *A47G 29/02* | (2006.01) |

(52) U.S. Cl. ..... 211/90.01

(58) Field of Classification Search ..... 211/87.01, 211/134, 189, 103, 187, 190, 193, 135, 186, 211/88.01, 90.01, 90.02, 90.03, 106.01; 108/106–108, 147.11, 147.17, 29, 30; 248/250, 248/235

See application file for complete search history.

(56) References Cited

U.S. PATENT DOCUMENTS

| | | | | | |
|---|---|---|---|---|---|
| 46,528 | A | * | 2/1865 | Macferran | 211/106.01 |
| 49,779 | A | * | 9/1865 | Motignani | 211/106.01 |
| 178,534 | A | * | 6/1876 | Latham | 248/235 |
| 224,863 | A | * | 2/1880 | Blessing | 248/241 |
| 31,724 | A | | 5/1885 | Tatem | |
| 592,250 | A | * | 10/1897 | Kuenzle | 211/106.01 |
| 750,595 | A | * | 1/1904 | Campbell | 248/250 |
| 797,614 | A | * | 8/1905 | Schipkowsky | 211/106.01 |
| 1,070,118 | A | | 8/1913 | Cornyn | |
| 1,111,304 | A | * | 9/1914 | Forester | 211/106.01 |
| 1,379,934 | A | * | 5/1921 | Paschke | 248/250 |
| D119,760 | S | * | 4/1940 | Kopp | D6/572 |
| 2,859,879 | A | * | 11/1958 | Rogers et al. | 211/90.01 |
| 3,163,132 | A | * | 12/1964 | Nelson | 108/152 |
| 3,294,351 | A | * | 12/1966 | Rollins, Jr | 248/243 |
| 3,419,155 | A | * | 12/1968 | Black et al. | 211/90.03 |
| 3,537,596 | A | * | 11/1970 | Brunette | 211/186 |
| 3,701,325 | A | * | 10/1972 | Fenwick | 108/1 |
| 3,920,210 | A | | 11/1975 | Einhorn | |
| 3,966,159 | A | * | 6/1976 | Brown | 248/250 |
| 3,998,332 | A | * | 12/1976 | Lambertson | 211/71.01 |
| 4,109,797 | A | * | 8/1978 | Brunette | 211/133.5 |
| 4,116,509 | A | * | 9/1978 | Smith | 312/107 |
| 4,125,078 | A | | 11/1978 | Nyquist | |

(Continued)

*Primary Examiner* — Joshua J Michener
*Assistant Examiner* — Devin Barnett
(74) *Attorney, Agent, or Firm* — Jeffrey A. Proehl; Woods, Fuller, Shultz & Smith, P.C.

(57) ABSTRACT

A shelving system may comprise a pair of support brackets and a shelf platform supportable by the brackets. The platform includes a supporting portion, a rear flange on the supporting portion, and a front flange on the supporting portion. The shelf platform may be configured to be supported by the support brackets when a portion of the brackets extend upwardly from the platform and when a portion of the brackets extend downwardly from the platform. Optionally, a work platform is pivotable between usage and storage positions, and the brackets are pivotable between a deployed position supporting the platform in the usage position and a storage position allowing the platform to move to the storage position. Optionally, a mounting rail and at least one hook removably mountable on the rail may be provided. The hook may have a stabilizer tab that stabilizes the hook with respect to the rail.

9 Claims, 12 Drawing Sheets

U.S. PATENT DOCUMENTS 4,154,420 A * 5/1979 Mazie et al. ..... 248/251
4,228,906 A 10/1980 Jones
D261,709 S 11/1981 Hartman
4,319,792 A * 3/1982 Britt et al. ..... 312/245
4,453,641 A * 6/1984 Rasmussen et al. ..... 211/151
D276,770 S * 12/1984 Kean ..... D6/323
4,537,316 A * 8/1985 Simon et al. ..... 211/133.3
D286,964 S * 12/1986 Gecchelin ..... D6/569
4,635,563 A * 1/1987 Hand et al. ..... 108/107
4,735,152 A * 4/1988 Bricker ..... 108/97
4,762,688 A * 8/1988 Berry, Jr. ..... 422/310
D314,115 S * 1/1991 Murphy ..... D6/574
4,984,759 A * 1/1991 Perlant ..... 248/99
5,069,408 A 12/1991 Bessinger
5,351,842 A * 10/1994 Remmers ..... 211/90.03
5,392,934 A 2/1995 Fox
5,406,894 A * 4/1995 Herrmann et al. ..... 108/108
5,452,875 A * 9/1995 Kern ..... 248/242
5,526,941 A * 6/1996 Ford ..... 211/59.1
5,580,018 A * 12/1996 Remmers ..... 248/235
5,592,886 A * 1/1997 Williams et al. ..... 108/108
5,624,168 A 4/1997 Licciardello
6,098,566 A * 8/2000 Metcalf ..... 114/362
6,113,042 A * 9/2000 Welsch et al. ..... 248/218.4
6,227,506 B1 5/2001 Benedict
6,364,263 B1 * 4/2002 Ryan ..... 248/250
6,499,608 B1 12/2002 Sterling
6,691,964 B1 * 2/2004 Schaefer ..... 248/250
6,763,958 B2 * 7/2004 Gervasi ..... 211/153
7,048,131 B2 5/2006 Gay
7,114,789 B2 10/2006 Keaton
7,249,685 B2 7/2007 Newman
7,314,144 B2 * 1/2008 Stitchick et al. ..... 211/125
7,322,483 B2 * 1/2008 Richardson ..... 211/90.02
7,392,911 B2 * 7/2008 Stitchick et al. ..... 211/90.02
7,407,060 B2 * 8/2008 Swartz et al. ..... 211/94.01
7,472,876 B2 * 1/2009 Jones ..... 248/242
7,478,785 B2 * 1/2009 Herron et al. ..... 248/243
7,497,343 B2 * 3/2009 Newman ..... 211/87.01
7,866,491 B2 1/2011 Newman
7,900,783 B2 * 3/2011 Fernandez et al. ..... 211/90.02
7,954,651 B2 * 6/2011 Kao ..... 211/70.6
2002/0170870 A1 * 11/2002 Callis ..... 211/119.003
2003/0019827 A1 * 1/2003 Wing et al. ..... 211/153
2003/0051643 A1 * 3/2003 Remmers ..... 108/147.17
2003/0052073 A1 * 3/2003 Dix ..... 211/90.02
2003/0173318 A1 * 9/2003 Rushing ..... 211/88.01
2004/0154498 A1 * 8/2004 Borgen et al. ..... 108/107
2004/0251388 A1 12/2004 Williams
2005/0045787 A1 * 3/2005 Magnusson ..... 248/235
2005/0145147 A1 * 7/2005 Costa et al. ..... 108/108
2005/0161569 A1 * 7/2005 Roberts ..... 248/250
2005/0284828 A1 * 12/2005 Remmers ..... 211/94.01
2007/0187561 A1 * 8/2007 Xayoiphonh ..... 248/235
2007/0221103 A1 * 9/2007 Trausch ..... 108/108
2008/0121146 A1 * 5/2008 Burns et al. ..... 108/23
2008/0156950 A1 * 7/2008 Rutz ..... 248/250
2009/0026342 A1 1/2009 Bochner
2009/0038983 A1 * 2/2009 Kieffer ..... 206/557
2009/0152217 A1 * 6/2009 Gmerek et al. ..... 211/27
2011/0017690 A1 * 1/2011 Wang ..... 211/87.01

* cited by examiner

SHELVING SYSTEM AND COLLAPSIBLE WORK BENCH

REFERENCE TO RELATED APPLICATION

This application claims the benefit of U.S. Provisional Patent Application No. 61/307,809, filed Feb. 24, 2010, which is hereby incorporated herein by reference in its entirety.

BACKGROUND

Field

The present invention relates generally to a shelving system and more specifically it relates to a shelving system and collapsible work bench for efficiently providing a customizable, easy to install shelving system and also for providing a collapsible work bench that may be easily installed and is simple to maneuver between a collapsed and a non collapsed position.

SUMMARY

In one aspect, the disclosure relates to a shelving system for attaching to a substantially vertical surface. In one aspect, The system may comprise at least a pair of support brackets for mounting on the substantially vertical surface, with each of the support brackets having a first portion and a second portion. Each of the first and second portions have inboard ends and outboard ends, with the respective inboard ends of the first and second portions of a support bracket being substantially permanently united together. The system may also comprise a shelf platform configured for being supported by the pair of support brackets, and the shelf platform may comprise a supporting portion having a substantially planar upper surface with a front periphery and a rear periphery, and a rear flange extending along the rear periphery of the upper surface of the supporting portion for positioning adjacent to the substantially vertical surface when the shelf platform is mounted on the support brackets mounted on the substantially vertical surface. The rear flange may be oriented substantially perpendicular to the upper surface of the shelf platform. The shelf platform may also comprise a front flange extending along the front periphery of the upper surface of the supporting portion, with the front flange being oriented substantially perpendicular to the upper surface for extending over an outboard end of the second portion of the support brackets when the shelf platform is mounted on the support brackets. The shelf platform may be configured to be supported by the first portions of the support brackets when the second portions of the support brackets extend upwardly from the shelf platform and when the second portions extend downwardly from the shelf platform.

In another aspect, the disclosure relates to a collapsible work bench system for attaching to a substantially vertical surface. The system may comprise at least a pair of support brackets for mounting on the substantially vertical surface, with each of the support brackets having a first portion and a second portion, each of the first and second portions having inboard ends and outboard ends, and the respective inboard ends of the first and second portions of a support bracket being substantially permanently united together. The system may also comprise a work platform configured for being supported by the pair of support brackets. The work platform may comprise a supporting portion having a substantially planar upper surface with a front periphery and a rear periphery, and a rear flange extending along the rear periphery of the upper surface of the supporting portion with the rear flange being oriented substantially perpendicular to the upper surface of the support portion. The work platform may comprise a front flange extending along the front periphery of the upper surface of the supporting portion, with the front flange being oriented substantially perpendicular to the upper surface for extending over an outboard end of the second portion of the support brackets when the work platform is mounted on the support brackets. The work platform may also comprise a hinge portion mounted on the rear flange for mounting on the substantially vertical surface to permit pivoting of the supporting portion with respect to the substantially vertical surface. The system may also include a hinge structure mounted on the support brackets to permit pivot movement of the support brackets with respect to the substantially vertical surface such that the support brackets are movable between a deployed position in which the support brackets are able to support the work platform in a substantially horizontal orientation and a storage position in which the support brackets permit the work platform to pivot downwardly to a storage position.

In still another aspect, the disclosure relates to a storage system comprising an elongated mounting rail for mounting on a substantially vertical surface, with the mounting rail having opposite ends and a length defined between the ends. The system may also comprise at least one hook removably mountable on the mounting rail, the hook having an inner end and an outer end, with the hook having a mounting portion toward the inner end and a support arm portion toward the outer end, the mounting portion defining an opening configured for receiving a portion of the mounting rail to mount the hook thereon and permitting the hook to slide along at least a portion of the length of the mounting rail, the opening being formed by an edge. The hook may also comprise a stabilizer tab portion extending from the mounting portion and being positioned adjacent to the opening to extend along and closely adjacent to a portion of the mounting rail when the rail extends through the opening.

In yet another aspect, the disclosure relates to a system for efficiently providing a customizable, easy to install shelving system and also for providing a collapsible work bench that may be easily installed and is simple to maneuver between a collapsed and a non collapsed position. The shelving system embodiment of the present invention generally comprises a horizontal shelf platform having a rear flange and a front flange, wherein the rear flange is adapted to rest parallel with and directly against a wall supporting surface, at least a pair of support brackets each having a horizontal portion for directly supporting the shelf platform and a vertical portion extending from the horizontal portion for being attached to the wall supporting surface, and wherein the front flange of the shelf platform extends over an outer end of the horizontal portion of each of the support brackets. At least one mounting rail extends between the pair of support brackets and is connected to the vertical portion of each of the support brackets thus being positioned substantially close to the wall supporting surface and distally spaced inwardly from the front flange of the shelf platform and including at least one hook supported by the mounting rail and adapted for slidable movement along the mounting rail and also restricted to a non rotatable movement with respect to the mounting rail.

In another aspect, the disclosure relates a collapsible work platform embodiment of the present invention generally comprises a work platform being pivotally connected to a wall supporting surface along a rear edge and at least a pair of support brackets each having a horizontal portion for directly supporting the shelf platform and a vertical portion extending from the horizontal portion for being pivotally connected to the wall supporting surface. In an in-use position of the work bench is comprised of the support brackets folded perpendicular to the wall supporting surface and the work platform resting horizontally thus being supported along a bottom surface by the support brackets. In a collapsed position of the work bench is comprised of the support brackets folded outwards or inwards thus being parallel with and positioned substantially against the wall supporting surface and the work platform being folded upwards or downwards to a vertical position also being parallel and positioned substantially against the wall supporting surface.

There has thus been outlined, rather broadly, some of the features of the invention in order that the detailed description thereof may be better understood, and in order that the present contribution to the art may be better appreciated. There are additional features of the invention that will be described hereinafter.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A first advantage of the present disclosure may be the provision of a customizable, easy to install shelving system.

Another advantage of the present disclosure may be the provision of a collapsible work bench that may be easily installed and is simple to maneuver between a collapsed and a non collapsed position.

A further advantage of the present disclosure may be the provision of a shelving system and collapsible work bench that requires fewer brackets than conventional shelving systems and work benches, thus minimizing installation time, maintenance, and cost. A further advantage may be the provision of a shelving system that has adjustable and non rotatable hooks.

A further advantage of the present disclosure may be the provision of a shelving system that may be suspended from above or below a shelf platform. A further advantage may be the provision of a shelving system that does not require any gussets thus freeing space beneath and/or above the shelf platform.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
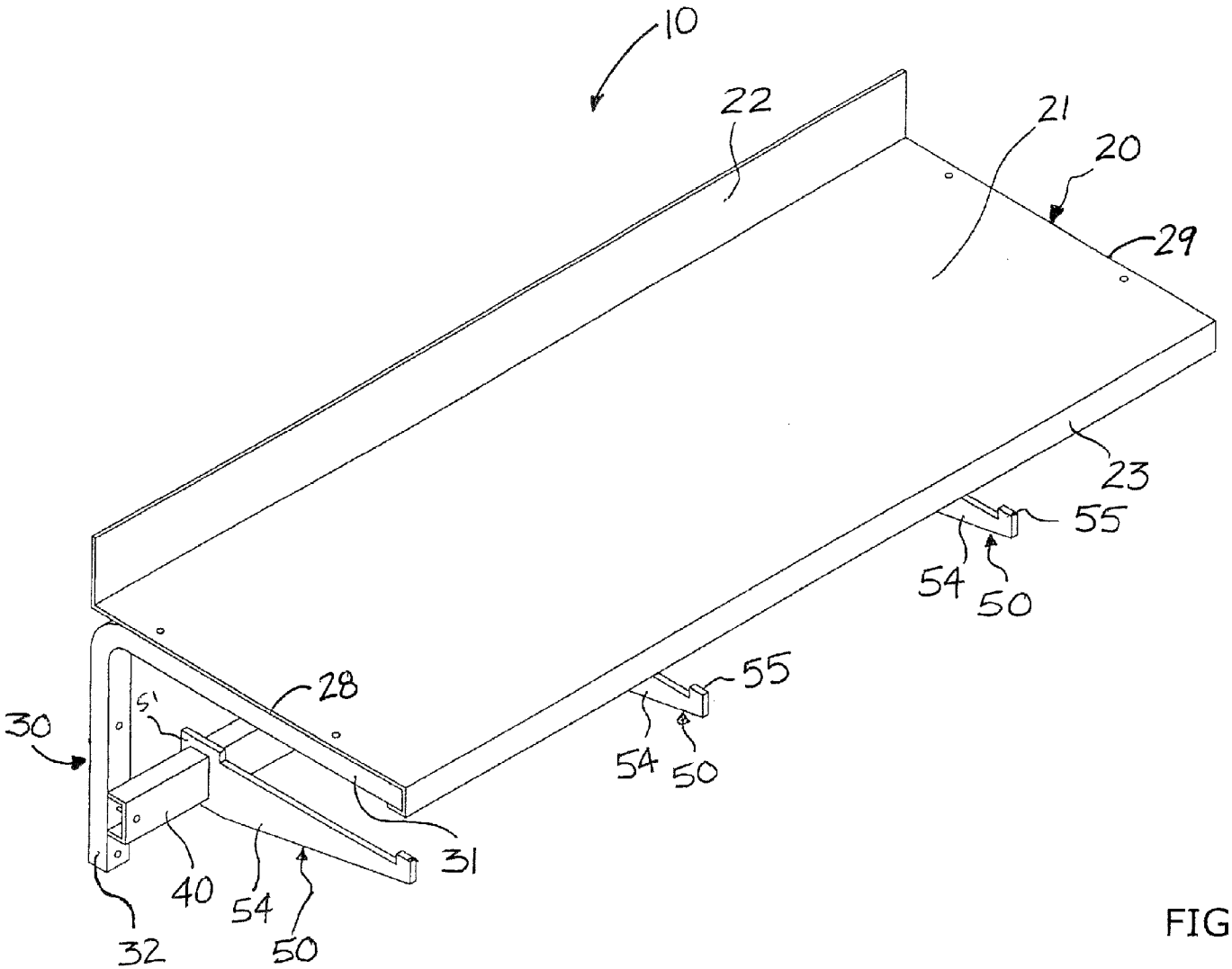
FIG. 1 is a schematic upper perspective view of an embodiment of the shelving system.

With reference now to the drawings, and in particular to FIGS. 1 through 12 thereof, a new shelving system and collapsible work bench embodying the principles and concepts of the disclosed subject matter will be described.

A. Overview

Turning now descriptively to the drawings, in which similar reference characters denote similar elements throughout the several views, FIGS. 1 through 7 illustrate a shelving system, which may comprise a horizontal shelf platform 20 having a rear flange 22 and a front flange 23, wherein the rear flange 22 is adapted to rest parallel with and directly against a wall supporting surface. The shelving system may further comprise at least a pair of support brackets 30 with a first portion 31 and a second portion 32. The first portion may be a horizontal portion 31 for directly supporting the shelf platform 20 and the second portion may be a vertical portion 32 extending from the horizontal first portion 31 for being attached to the wall supporting surface. The front flange 23 of the shelf platform 20 may extend over an outer end of the horizontal portion 31 of each of the support brackets 30. The system may include at least one mounting rail 40 may extend between the pair of support brackets 30 and may be connected to the vertical portion 32 of each of the support brackets 30 thus being positioned substantially close or adjacent to the wall supporting surface and distally spaced inwardly from the front flange 23 of the shelf platform 20. The system may comprise at least one hook 50 supported by the mounting rail 40 and adapted for slidable movement along the mounting rail 40 and may also be restricted to a non rotatable movement with respect to the mounting rail 40.

FIGS. 8 through 11 illustrate a collapsible work platform 60 embodiment of the present disclosure, which comprises a work platform 60 being pivotally connected to a wall supporting surface along a rear edge and at least a pair of support brackets 70 each having a second portion 71 that may be substantially horizontally oriented for directly supporting the work platform 60 and a second portion 72 that may be substantially vertically oriented for extending from the horizontal portion 71 for being pivotally connected to the wall supporting surface. In an in-use or usage position, the work bench has the support brackets 70 positioned substantially perpendicular to the wall supporting surface and the work platform 60 supported along a bottom surface by the support brackets 70 and thus resting substantially horizontally. In a collapsed or storage position, the work bench has the support brackets 70 folded outwards or inwards toward and thus being parallel with the wall supporting surface or the work platform, and the work platform 60 may be folded upwards or downwards to a substantially vertical position that may also be parallel and positioned substantially adjacent to or against the wall supporting surface.

B. Shelf Platform

In some preferred embodiments, the shelf platform 20 comprises a supporting portion 21 generally comprising a major portion of the shelf platform 20. The supporting portion 21 is used to support objects or items thereon and is generally comprised of a planar structure and oriented in a horizontal manner. The supporting portion 21 may have a substantially planar upper surface 24 with a front periphery 26 and a rear periphery 27, and may also have a pair of opposite side edges 28, 29. The shelf platform 20 may be configured to be supported by at least one, and in most cases at least two, of the support brackets 30.

Significantly, the supporting portion 21, as well as the rest of the shelf platform 20, may be suspended or supported from above or below as will be described below. This capability provides the user of the system with different options for mounting depending upon, for example, the conditions at the location where the shelf system is to be utilized, and also does not require the use of different parts to permit the different mounting positions.

Extending from a rear end or rear periphery 27 of the supporting portion 21 may be a rear flange 22, which may define a rear peripheral edge of the shelf platform 20. The rear flange 22 may help to stiffen the shelf platform toward the rear periphery, and may be positioned adjacent to (and optionally against) the substantially vertical surface when the shelf platform is mounted on the support brackets 30 when the brackets are in turn mounted on the substantially vertical surface. The rear flange 22 may be oriented substantially perpendicular to the upper surface 24 of the shelf platform. The rear flange 22 may extend between and to the opposite side edges 28, 29. The rear flange 22 may define a type of backsplash for the shelf platform 20 and may comprise a vertical sheet extending upwardly from the rear end of the supporting portion 21 to rest flat against and parallel with the wall supporting surface. The rear flange also serves to reinforce the supporting portion 21 along the rear periphery, similar to the reinforcement of the front periphery by the front flange.

Extending from a front end or front periphery 26 of the supporting portion 21 may be a front flange 23, which may define a front peripheral edge of the shelf platform 20. The front flange 23 defines a type of front lip for the shelf platform 20 and comprises a vertical sheet that may extend downwardly from the front end of the supporting portion 21 and substantially perpendicular to the upper surface 24 to rest or extend over the outer or outboard ends of the horizontal second portions 31 of the support brackets 30 when the shelf system is assembled. The front flange may thus conceal the ends of the support brackets and may give the system a more finished look and greater aesthetic appeal. The front flange 23 may further include a return 19 that extends slightly inward such that the front flange 23 forms an elongated channel for receiving the outboard ends of the second portion 31 of the support brackets. The front flange may thus form a backwards L-shape. The configuration of the front flange 23 may also help to stiffen and reinforce the front periphery of the supporting portion of the shelf portion, and particularly may be accomplished using the same material, and piece of material, as the supporting portion without the need for additional elements such as reinforcing members. Further, the distance between support brackets may be increased by the strengthened character, and may allow for the use of fewer brackets for a given shelf platform length. Also, end portions of the shelf platform may extend past or overhang from a support bracket for a distance due to the reinforcing nature of the front and rear flanges.

Optionally, a pass-through opening 25 may be formed in the supporting portion 21 of the shelf platform such that a portion of one of the support brackets 30 may be extended through the shelf platform to suspend the shelf from a higher location on the substantially vertical surface. The presence of the opening 25 permits the support bracket to be mounted on the substantially vertical surface at a location that is relatively above the supporting portion 21 with the bracket extending through the opening to a position below the supporting portion so that the shelf platform may rest upon the second portion 31 of the bracket. The pass through opening 25 may be positioned toward the rear periphery of the upper surface of the supporting portion, and may be located adjacent to the rear flange 22. Also, a plurality of fastener holes may be formed through the shelf platform for receiving fasteners for fastening the shelf platform to the shelf brackets.

Both the rear flange 22 and the front flange 23 may be seamlessly built into the shelf platform 20 and may be integral with the supporting portion 21, and the integral character may further enhance the strength of the shelf platform. Each of the front flange 23 and the rear flange 22 are preferably perpendicular to the supporting portion 21 of the shelf platform 20.

The shelf platform 20 may be comprised of various sizes all of which are suitable for the desired shelving application. The shelf platform 20 is generally comprised of a rectangular shape; however other shapes may be appreciated. The shelf platform 20 may also be comprised of various materials, such as but not limited to steel, molded plastic, or possibly recycled cardboard (e.g. milk cartons) all which provide for superior strength and support.

The shelf platform 20 is preferably comprised of a one-piece integrally formed or molded structure thus requiring less brackets, materials, and easier installation. Further, the shelf platform 20 is preferably comprised of a sheet material or substantially thin structure to provide for a lightweight and non obtrusive structure. Traverse beams or supports may also be built into the shelf platform 20 for further added support. The shelf platform may thus function as a shelf and may also function as a workbench surface, with or without the features of the workbench platform set forth below, C. Support Brackets The support brackets 30 are generally positioned at opposing longitudinal ends of the shelf platform 20; however it is appreciated that more or less support brackets 30 may be utilized with the shelf platform 20 depending on the length of the shelf platform 20 and the weight that the shelf platform 20 is required to hold. The support brackets 30 generally form the sole support for the shelf platform 20, and the use of gussets to reinforce the first and second portions of the brackets is not required thus freeing space below the shelf platform 20 and preventing interference with the space below the shelf to prevent any safety hazards, obtrusive structures, or structures generally in the way below the shelf platform 20. Further, the absence of gussets or other reinforcing members between the first and second portions of the brackets (except for their connection together) allows for the supportive positioning of the brackets above or below the shelf platform. In some highly preferred embodiments, the support brackets 30 are generally comprised of a material suitable to provide rigidity in horizontal, vertical, and diagonal axis thus eliminating the need for gussets. These characteristics may be provided, for example, by utilizing square or rectangular tubing as illustrated, although other materials may also be suitable. It has been found that approximately 1.5 inch square tubing is highly suitable for the desired strength and rigidity characteristics. It is appreciated that the cross-sectional profile of the end brackets may be rectangular, such as but not limited to where multiple shelf platforms 20 join. Notably, the use of bent tubing eliminates the time and cost involved with welding or otherwise joining separate elements together to form a bracket.

Each of the support brackets 30 may have having a first portion 31 and a second portion 32, and each of the first and second portions may have inboard ends and outboard ends, with the respective inboard ends of the first and second portions being substantially permanently united together, and the respective outboard ends being free ends. Many preferred embodiments of the brackets have the first and second portions connected only at the inboard ends thereof such that space between the first and second portions are free of connecting structure.

The first 31 and second 32 portions may be configured so that the shelf brackets are substantially L-shaped, and the first and second portions may be oriented generally perpendicular to each other, such that the first portion may be oriented substantially horizontally when the second portion is oriented substantially vertically. The first and second portions of the shelf brackets may each have a longitudinal axis, and may form an angle between the longitudinal axes of the first and second portions. The angle may be substantially perpendicular, and may have a measurement between approximately 80 degrees and approximately 100 degrees (inclusive), Each of the support brackets 30 generally includes a first portion 31 that may be positioned in a generally horizontal orientation against and parallel to the supporting portion 21 of the shelf platform 20 and used for supporting the shelf platform 20 in a horizontal orientation. The substantially horizontal first portion 31 of the end brackets may be connected to the shelf platform 20, such as by fasteners passing through fastener holes formed in the platform and the first portion, when the first portion 31 is positioned beneath or above the shelf platform 20 to support and stabilize the shelf platform 20. The first portions 31 of the brackets may also be simply positioned underneath the supporting portion 21 of the shelf platform 20 and not fastened thereto if desired, so that the supporting portion rests upon the first portion without substantial connection therebetween, and any weight placed upon the shelf platform 20 tends to retain the shelf platform 20 in contact with the first portions 31 of the support brackets 30.

Each of the support brackets also generally includes a second portion 32 extending substantially vertically from an inner or inboard end of the horizontal first portion 31 of the respective bracket. The vertical second portions 32 may be oriented so as to extend downwardly, such as when the horizontal first portion 31 supports the shelf platform 20 from below a plane defined by the upper surface of the shelf platform, or the vertical first portions 32 may be oriented so as to extend upwards, such as when the horizontal first portion 31 supports the shelf platform 20 from above the plane defined by the upper surface of the shelf platform.

Figure 6:
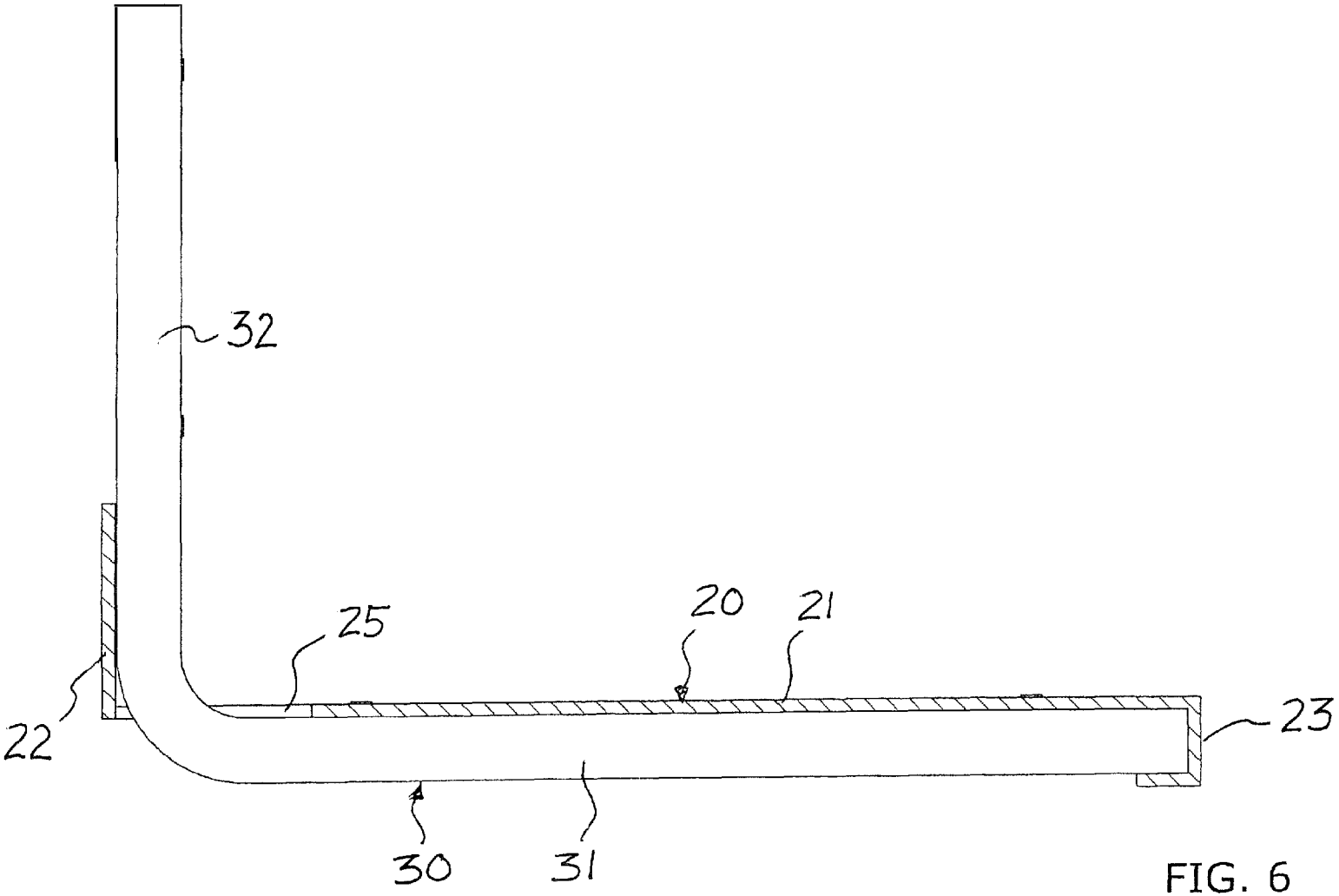
FIG. 6 is a schematic side sectional view of an embodiment of the shelving system with optional features.

The vertical second portion 32 is generally securely affixed against and parallel to the wall supporting surface using various types of fasteners, such as lag bolts, etc. The fasteners are generally extended within studs supporting the wall supporting surface. The vertical second portion 32 thus may include various openings spaced therealong for receiving the fasteners, etc. to mount the second portion to the substantially vertical surface, In an optional embodiment, the corner of the support bracket 30 (where the vertical portion 32 and horizontal portion 31 meet) may extend through the pass through opening 25 in the shelf platform 20, such that the vertical second portion 32 extends vertically upward above the shelf platform 20 and the horizontal first portion 31 is positioned below the shelf platform 20 to support the shelf platform 20 from the underside. In embodiments with the opening 25 as shown in FIG. 6, a thin plate-like spacer (not shown) may be positioned above the rear flange 22 and behind the vertical second portion 32 to provide additional support and connecting points to the vertical second portion 32 of the support brackets 30. The spacer preferably terminates at an upper end of the vertical second portion 32 to provide for a finished appearance.

D. Mounting Rail

The system 10 may include at least one mounting rail 40 that is mountable on a pair of the support brackets 30, and the mounting rail may be mountable on the first portions 31 of the support brackets. The mounting rail 40 may be being elongate in shape with opposite ends, and the end portions of the mounting rail adjacent the ends may be mounted on the support brackets.

Figure 2:
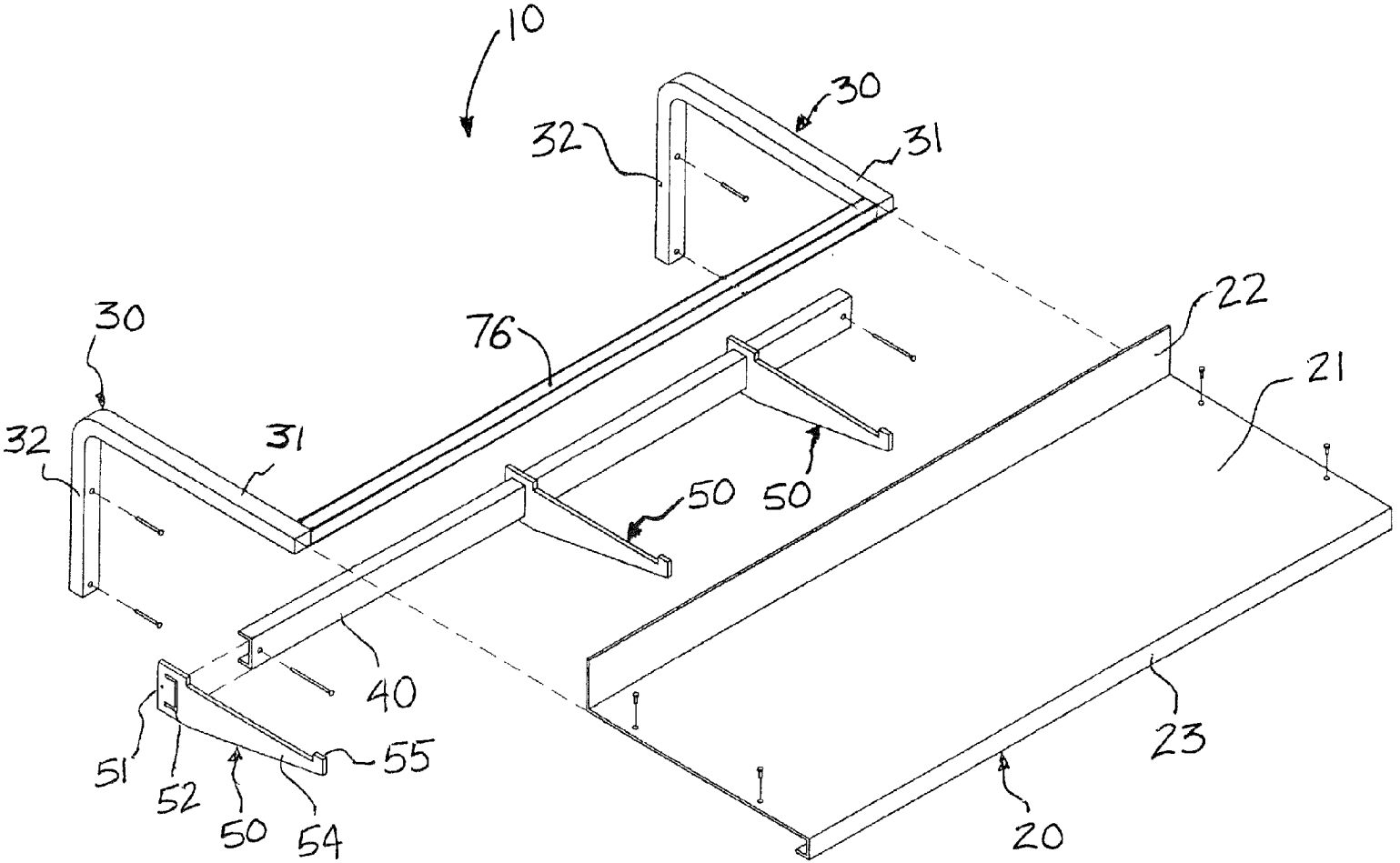
FIG. 2 is a schematic exploded upper perspective view of an embodiment of the shelving system.
Figure 3:
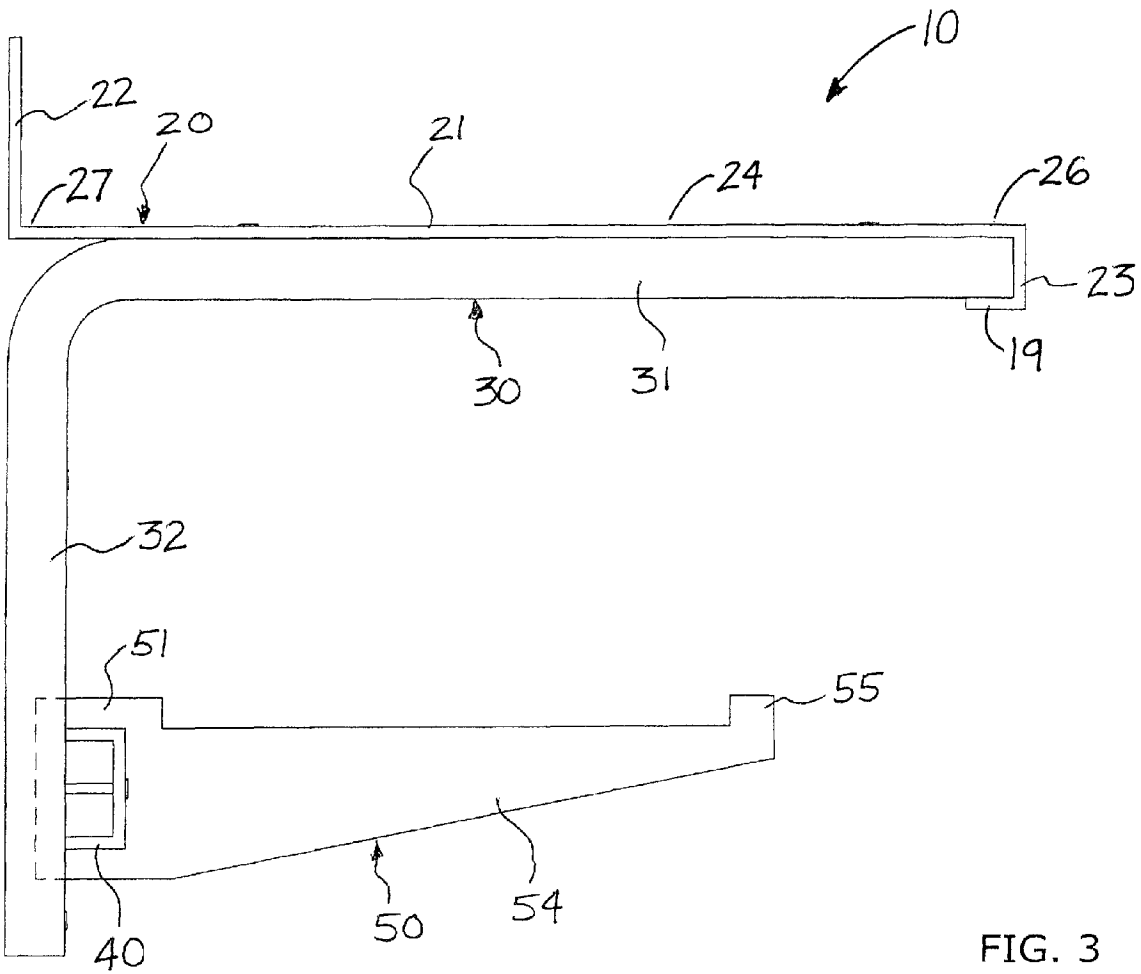
FIG. 3 is a schematic side view of an embodiment of the shelving system.

The elongated mounting rail 40 generally extends from and between end support brackets 30 and is preferably securely fastened to the end support brackets 30 using various types of fasteners, such as bolts, etc. FIG. 2 illustrates a bolt extending through the ends of the mounting rail 40 that would be subsequently fastened within openings (not shown) of the vertical second portion 32 of the respective support bracket 30. The mounting rail 40 may be mounted at various height locations along the vertical second portions 32 of the end support brackets 30 as desired. The mounting rail 40 generally may be comprised of a metal or a molded plastic material to provide superior rigidly and strength. It will be appreciated that more than one mounting rail 40 may be secured to the support brackets 30, wherein multiple mounting rails 40 may be vertically spaced along the vertical second portion 32 of the support brackets 30.

As stated, the mounting rail 40 is generally securely affixed to the vertical portions 32, thus being substantially close (e.g. a few inches) to the wall supporting surface thus only leaving space for the rear portion of the hook 50 to travel. The mounting rail 40 may be comprised of various cross-sectional shapes, such as but not limited to a tubular or closed cross sectional perimeter shape, such as a square shape, a rectangular shape, or a triangular shape, or an open cross sectional perimeter shape such as a U-channel shape or a C-channel shape, and is preferably any shape that prevents rotational movement of the hook 50 member with respect to the rail when the hook is slidably secured on the rail. It has been found that 1 inch square tubing or 1 inch by 1.5 inch rectangular tubing is suitable for the mounting rail, although other sizes and shapes may also be suitable. In optional embodiments, the mounting rail 40 may be mounted directly to a rail bracket which is secured to the wall supporting surface, such as when no support brackets 30 are in the nearby vicinity.

E. Hooks.

One or more hooks 50 are preferably mounted or mountable to each mounting rail 40 in a manner that preferably (although not critically) allows slidable movement of the hook along at least a portion of the length of the mounting rail 40 and that preferably (although not critically) restricts rotatable movement of the hook relative to the mounting rail 40. The fastened ends or end portions of the mounting rail 40 to the support brackets 30 may prevent the hooks 50 from sliding off of the mounting rail 40 when it is secured to the brackets. Each hook 50 may be preferably able to be freely slidably adjustable along the respective mounting rail 40 as desired. It may be appreciated that one or more hooks 50 may be semipermanently or permanently affixed to the mounting rail 40, thus not allowing or easily allowing slidable movement. Such restriction on sliding may be accomplished in a number of different ways, such as but not limited to, by using magnets upon the mounting rail 40 or the hooks 50, by fastening each individual hook 50 to the mounting rail 40 with fasteners such as, for example, self-drilling screws, bolts, etc. The hooks 50 preferably may each be comprised of a metal or steel or molded plastic material having a vertically-oriented plate structure to provide superior hanging strength. In some highly preferred embodiments, the hook is cut from a sheet material or plate of suitable strength and rigidity, and bent or contoured as needed, and may be formed without welding bonding of separate elements together.

Each hook 50 may have an inner end for positioning toward or on the mounting rail and an outer end for positioning away from the rail relative to the inner end. Each hook 50 preferably includes a locking or mounting portion 51 located toward the inner end and having an opening 52 extending therethrough to receive at least a portion of the mounting rail, and which may also be located toward the inner end. The opening 52 may have a perimeter shape that is configured to restrict the hook against rotation with respect to the mounting rail when the rail extends through the opening, while allowing slidable movement along the mounting rail 40 but restricting rotational movement. The mounting portion 51 is located at the rear of the hook 50 and generally slides or is positioned near the substantially vertical wall supporting surface.

Figure 4:
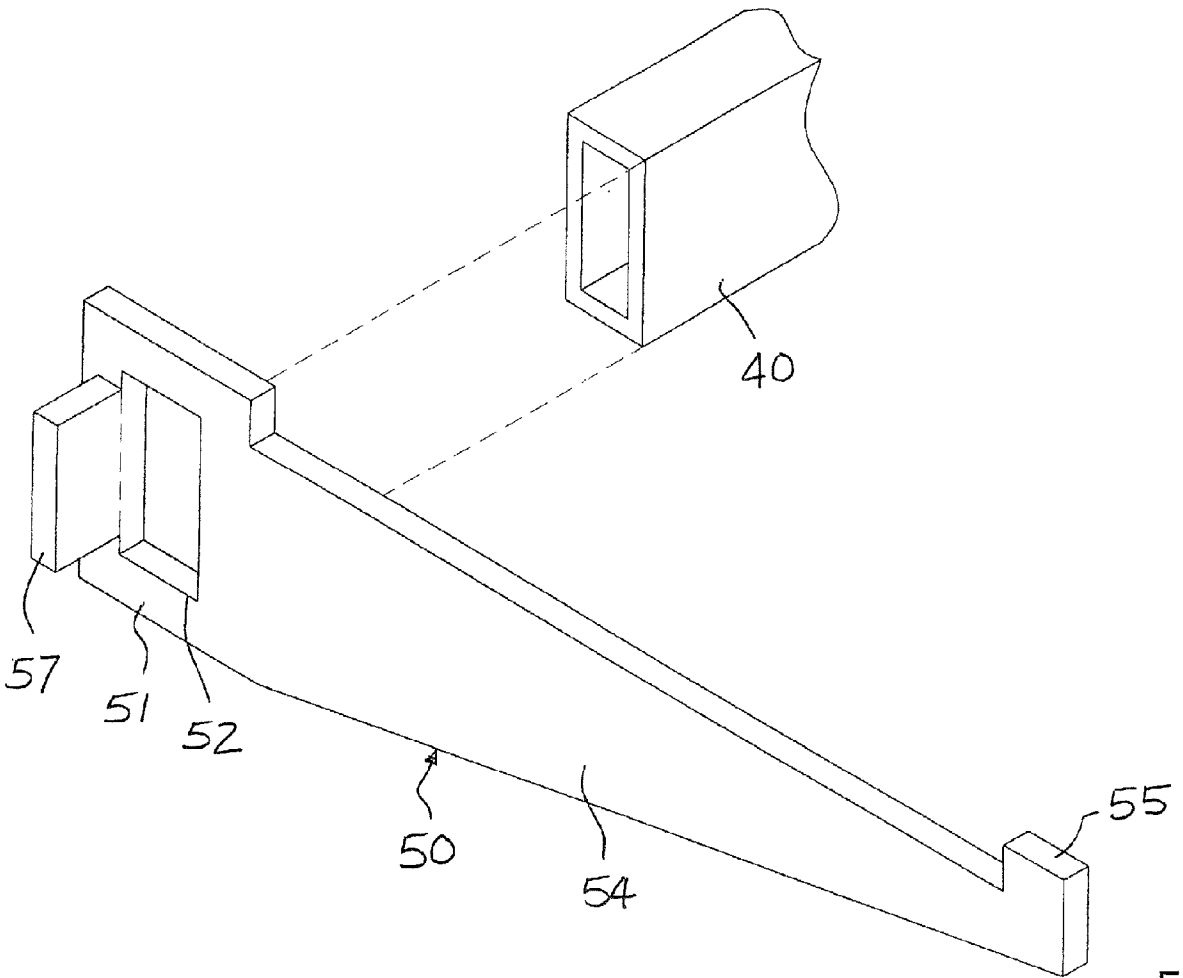
FIG. 4 is a schematic upper perspective view of an embodiment of a hook shown exploded from the mounting rail.
Figure 5:
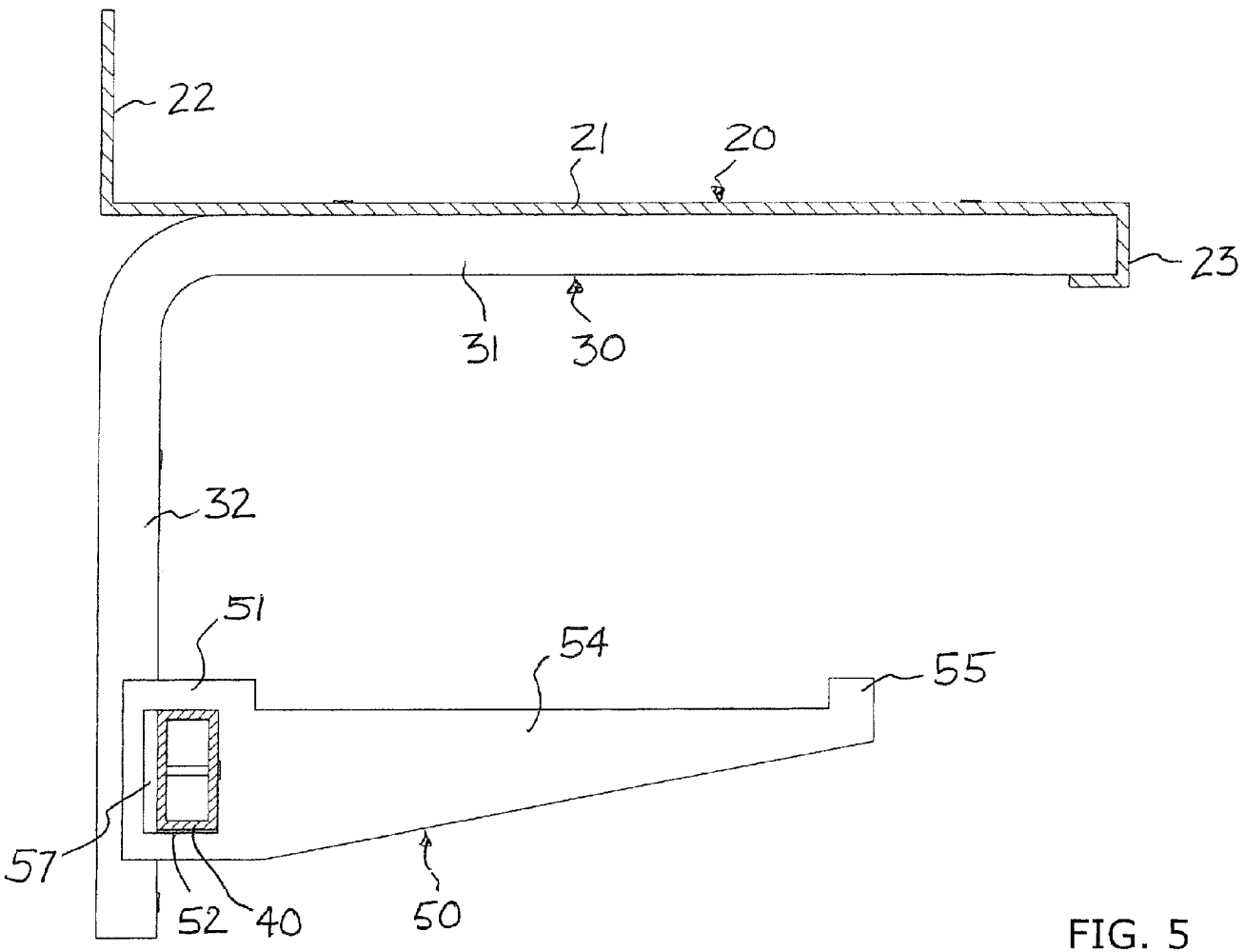
FIG. 5 is a schematic side sectional view of an embodiment of the shelving system.
Figure 7:
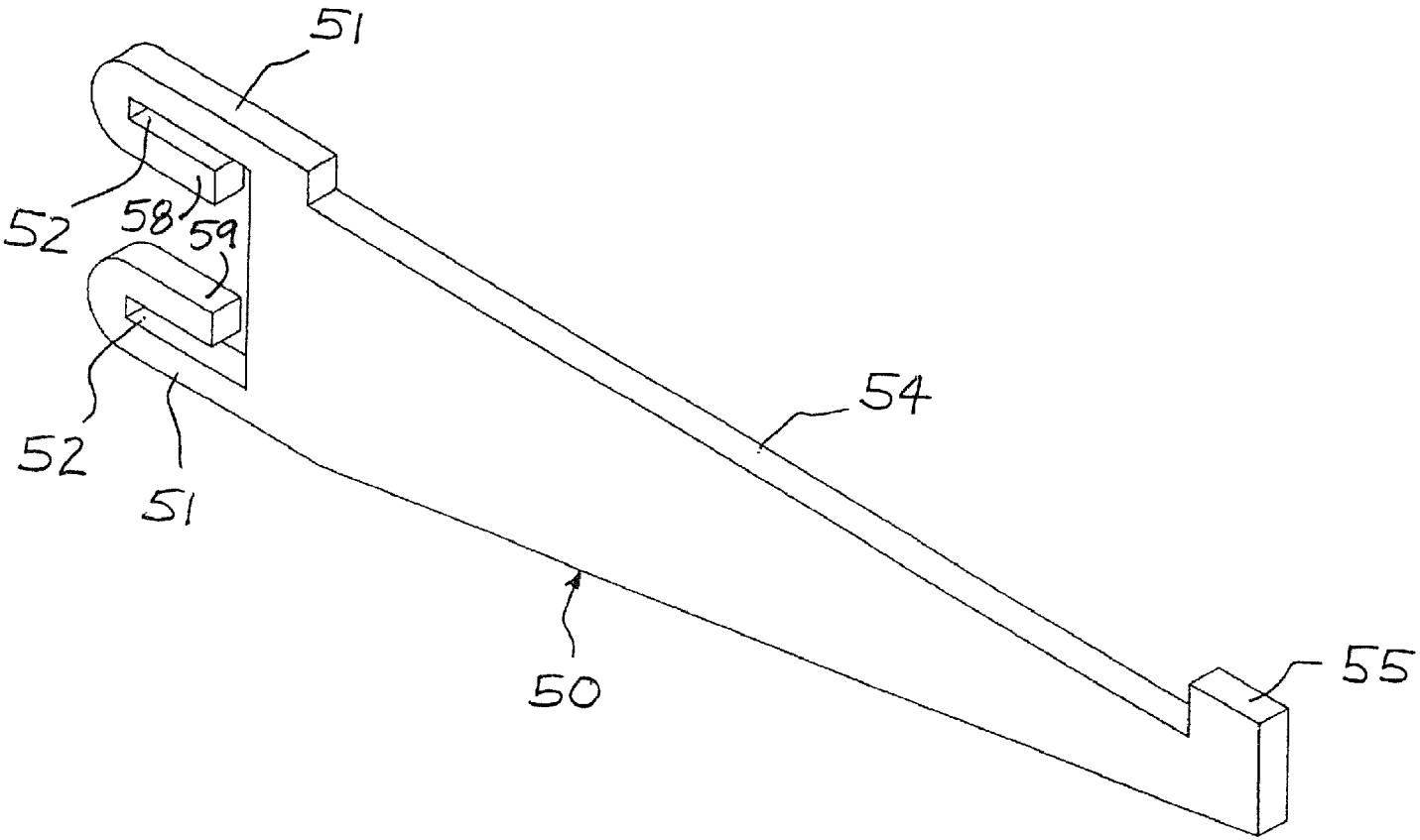
FIG. 7 is a schematic perspective view of an embodiment of the hook.
Figure 8:
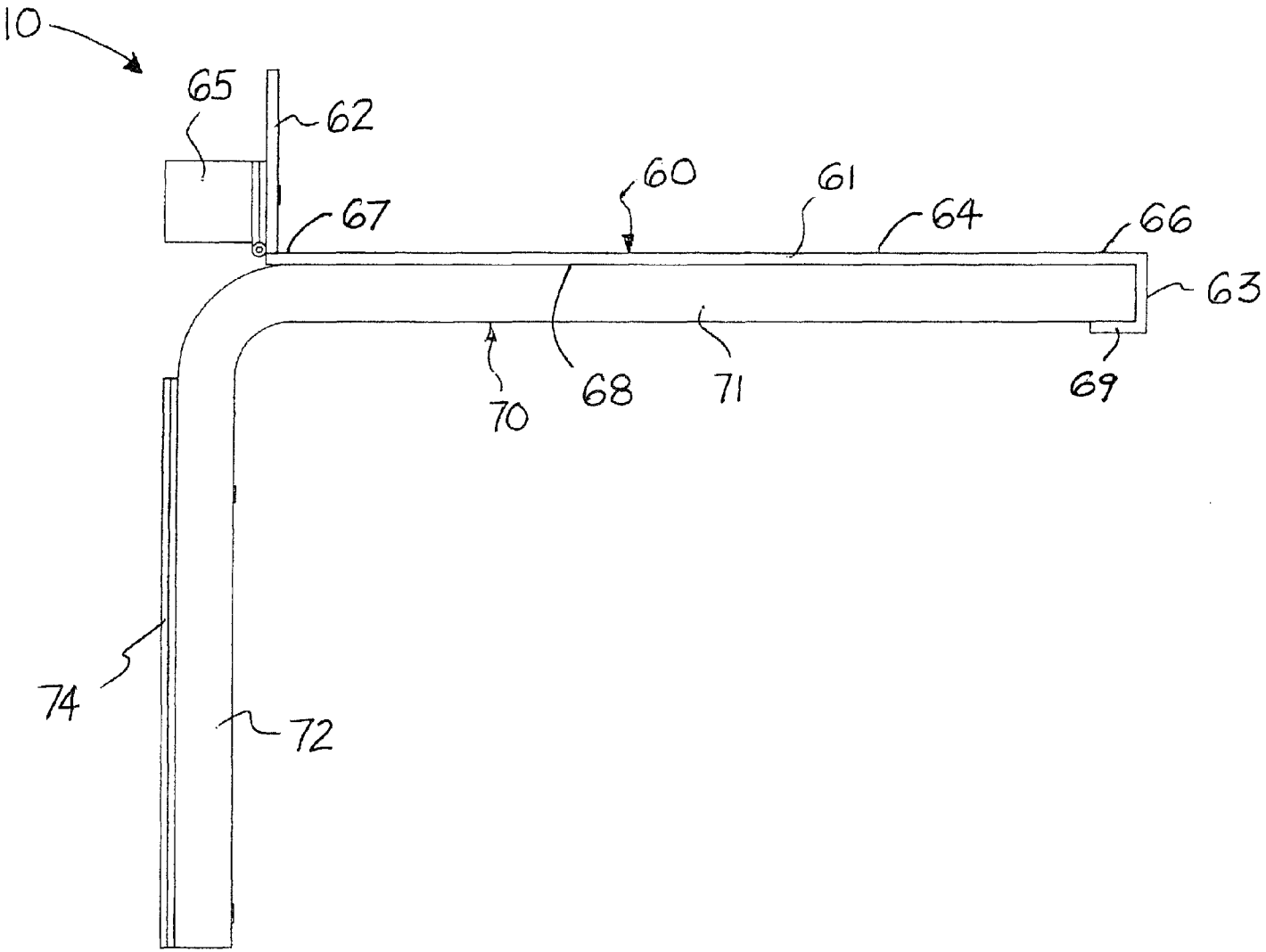
FIG. 8 is a schematic side view of an embodiment of the work bench in the in-use position.
Figure 9:
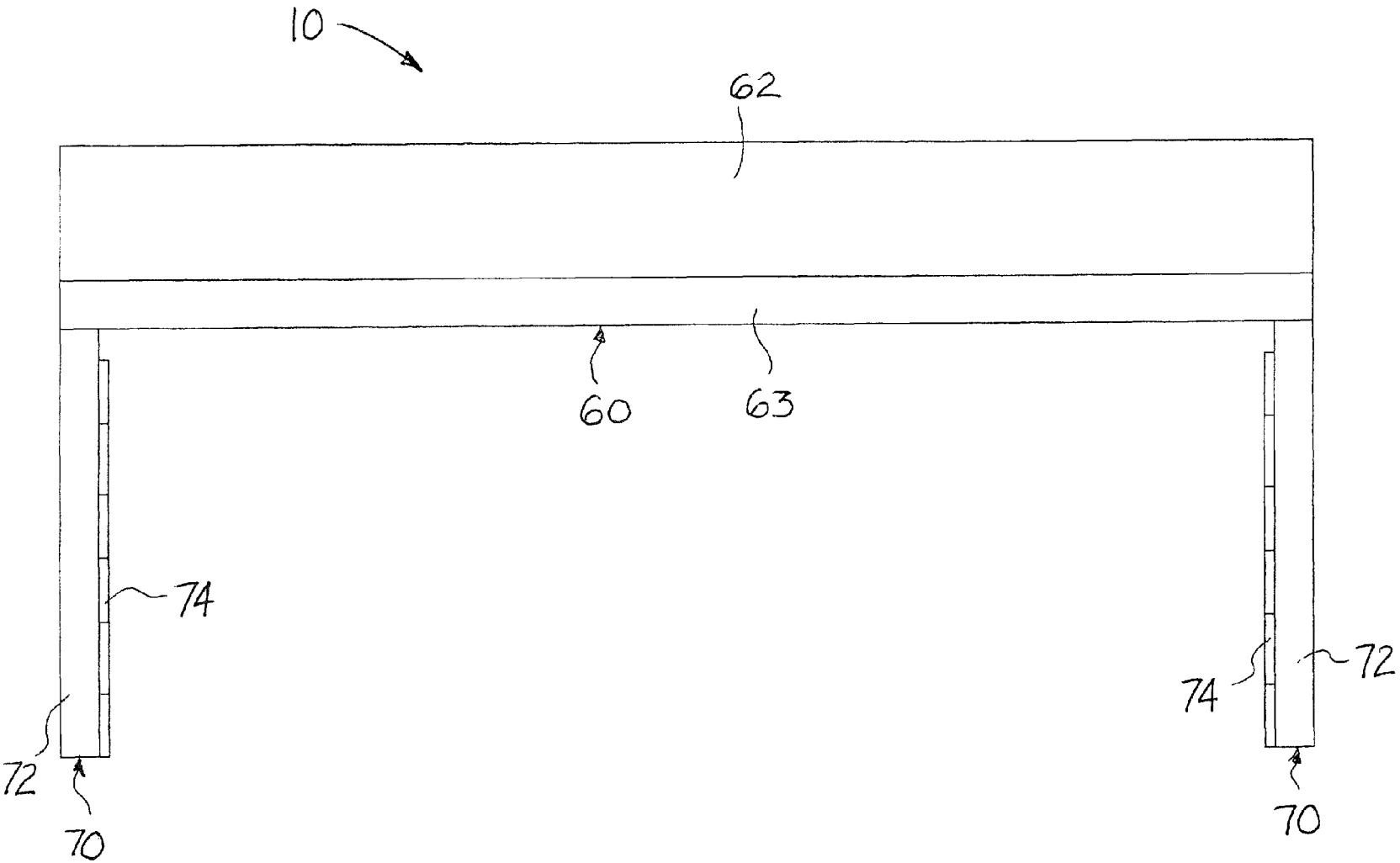
FIG. 9 is a schematic front view of an embodiment of the work bench shown in the in-use position.
Figure 10:
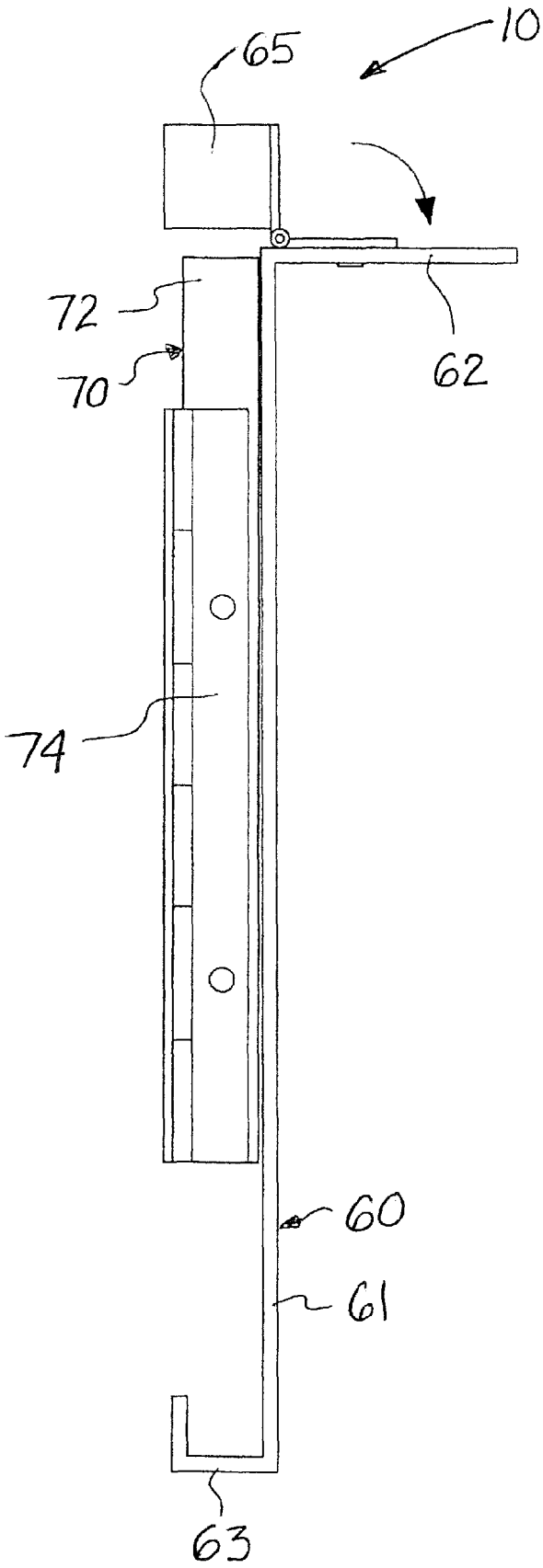
FIG. 10 is a schematic side view of an embodiment of the work bench shown in the collapsed position.
Figure 11:
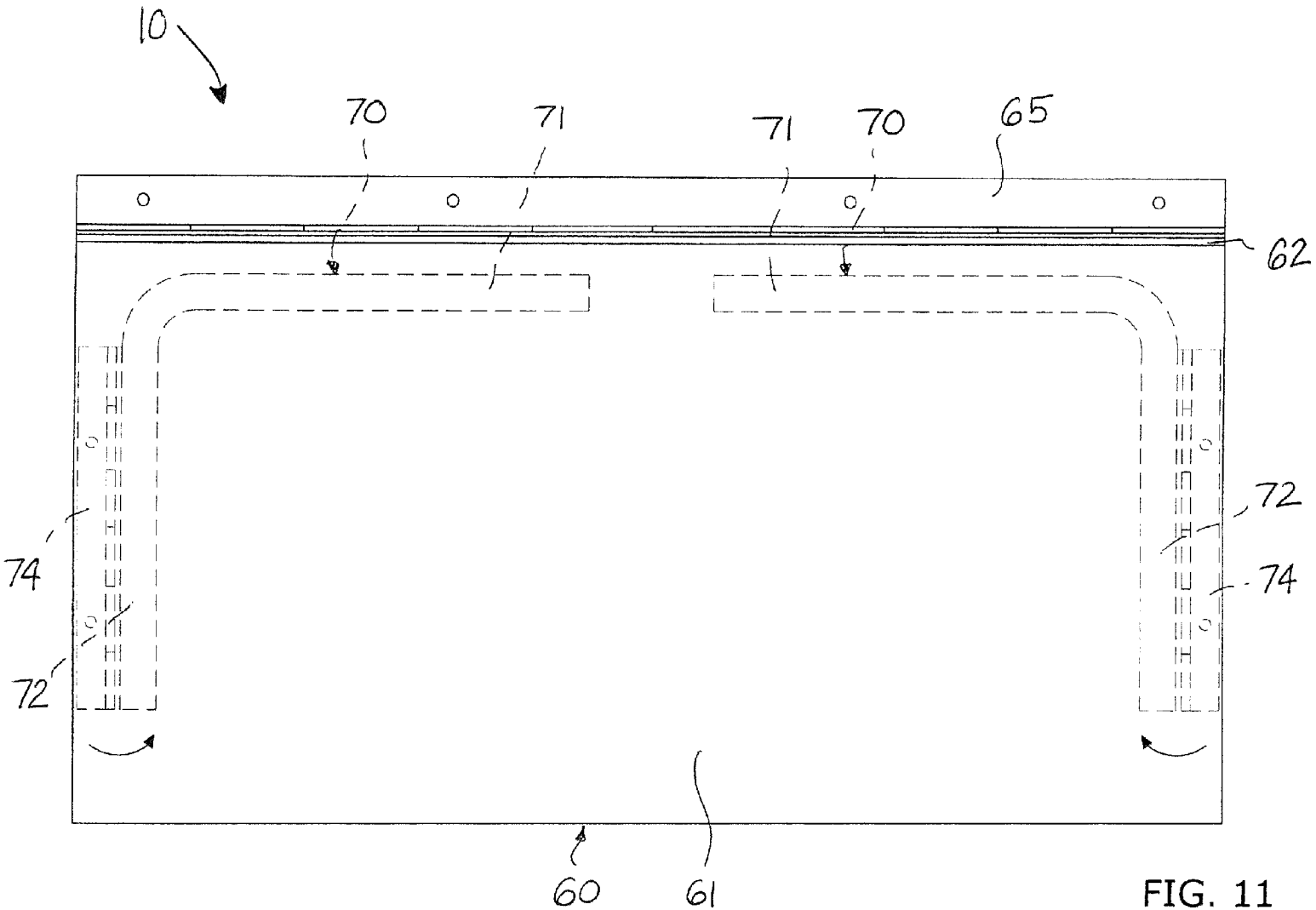
FIG. 11 is a schematic front view of an embodiment of the work bench shown in the collapsed position.
Figure 12:
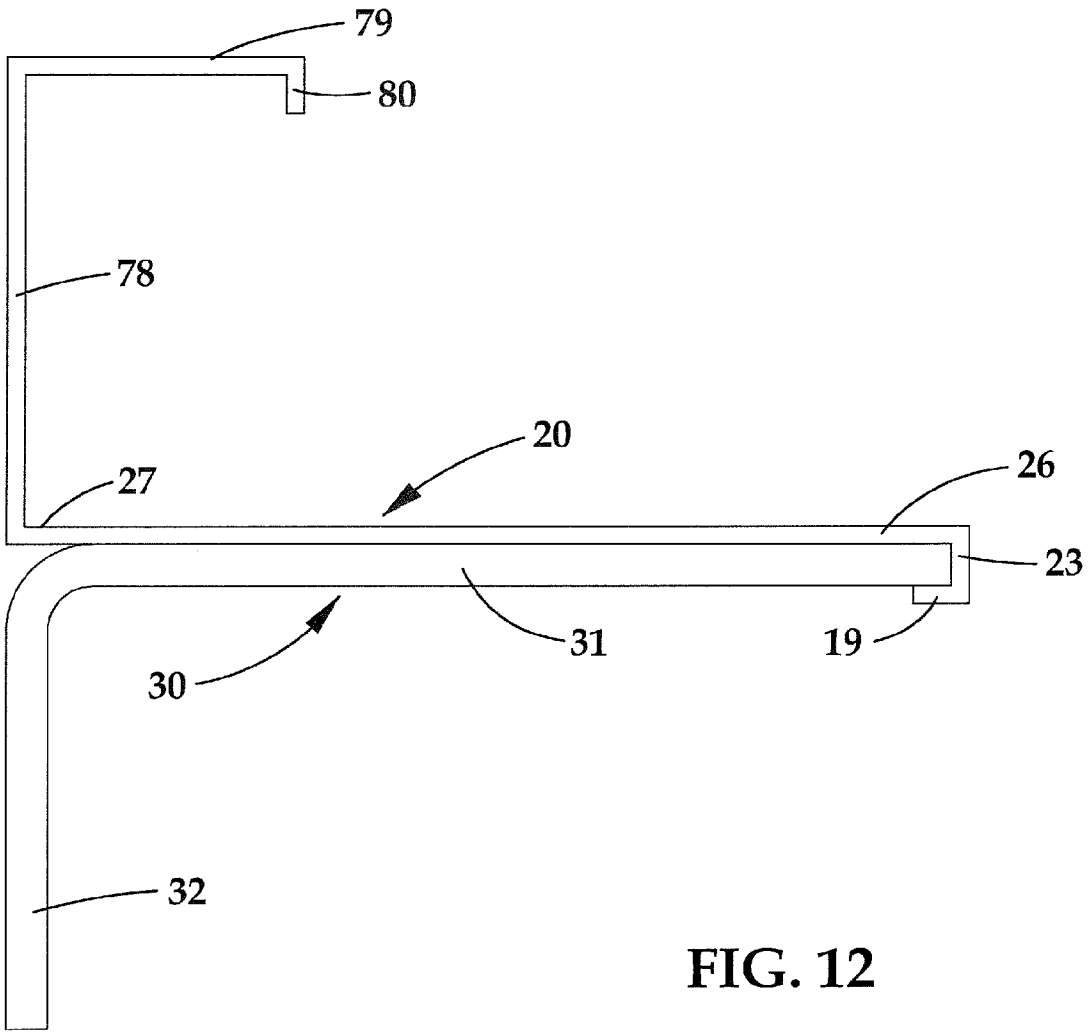
FIG. 12 is a schematic side view of an embodiment of the platform having an enhanced rear flange structure.

In some embodiments, the opening 52 is formed by a continuous edge extending about the opening, and the opening has a shape and size that generally corresponds to the cross sectional exterior perimeter shape of the mounting rail to permit sliding but tends to prevent rotation, and may also resist dislodgment from the rail when bumped. In some embodiments, the mounting portion of the hook forms a locking structure, and the opening is formed in a manner that does not have a continuous perimeter edge, such as is shown in FIG. 7. In the illustrative embodiments, the locking structure includes a pair of fingers 58, 59 for engaging the mounting rail, and each of the fingers may form a side of the opening for receiving a portion of the mounting rail. The mounting portion 51 may thus have an open rear part leading to the opening 52 as shown in FIG. 7, or may have a closed rear part thus closing the opening 52 from a rear end of the hook 50 as shown in FIG. 4.

The mounting portion 51 also preferably includes one or more stabilizer tabs 57 laterally extending therefrom to be oriented substantially parallel to the mounting rail 40 and engage a forward or rearward side of the mounting rail 40 to thus help to prevent the hook 50 from twisting or turning or pivoting while the hook is positioned upon the mounting rail 40. The stabilizer tab or tab portion may be positioned adjacent to the opening 52 to extend along a portion of the mounting rail when the rail is passed through the opening, The stabilizer tab 57 are thus generally perpendicular to the extent of the rest of the hook 50. The stabilizer tab 57 may include the magnets therein or may be used as the portion of the hook 50 to be attracted by the magnets mounted on the mounting rail since the stabilizer tabs 57 face the mounting rail 40 and have a relatively larger surface area facing the mounting rail 40 than an edge of the hook forming the opening 52.

Extending from the mounting portion 51 is a support arm portion 54. The support arm portion 54 extends forwardly from the mounting portion to extend a distance forward from the mounting rail 40 and from the wall supporting surface for hanging objects. The support arm portion 54 may generally have an upwardly slanting lower edge to free space and restrict accidental engagement with the hook 50 and a flat upper edge for supporting objects thereon. The support arm portion 54 may also include one or more catches 55 extending upwardly from the upper edge of the support arm portion 54 for retaining items upon the upper edge of the support arm portion 54. It will be appreciated that the support arm 54 may include one catch 55 located at a distal end and may also include one or more catches 55 spaced along the upper edge of the support arm portion 54 for defining spaces to hang objects therefrom.

The hooks, and the support arm portions 54 thereof, may be adapted or configured to support a variety of items, such as, for example, hockey sticks, baseball bats, bicycles, tools, boots, fishing rods, paper towel rolls, snow skis, water skis, snow boards, hats, and the like. Further, the hooks may incorporate other elements that may or may not have the purpose of support, and may include, for example, a bottle opener or a drinking glass support or coaster. While the attachments for the mounting rail are termed "hooks" in this disclosure, it will be recognized that other elements that may not have a hook function may be utilized and mounted on the mounting rail.

F. Work Platform.

In an optional embodiment of the present disclosure, a work platform 60 may be utilized. The work platform 60 may have a somewhat similar configuration and construction as the shelf platform 20, and thus may have a rear flange 62, a front flange 63, and a supporting portion 61 that may be similar to that described for the shelf platform. The rear end of the work platform 60, such as the rear flange 72, is preferably pivotally connected to the wall supporting surface by a hinge portion 65 that allows the work platform 60 to fold or pivot between a substantially horizontal orientation in an in-use or usage position and a substantially vertical orientation in a collapsed or storage position. It will be appreciated that the work platform 60 may be pivoted from the usage position upwards or downwards to the storage position generally above or below the hinge portion 65, and may be temporarily secured in a substantially vertical orientation via various types of locking structures or elements.

The supporting portion 61 is generally pivotable with respect to the hinge portion 65 such that the hinge portion remains substantially stationary while the supporting portion moves upwardly or downwardly. The supporting portion may be moved from the substantially horizontal usage position to a lowered storage position or a raised storage position, each of which has the supporting portion substantially vertically oriented. The supporting portion may have a substantially planar upper surface 64 with a front periphery 66 and a rear periphery 67, as well as a pair of opposite side edges, and a lower surface 68 located opposite of the upper surface.

The hinge portion 65 may be configured to mount on a substantially vertical surface. The rear flange 62 may be oriented substantially perpendicular to the upper surface 64 of the supporting portion in the usage position, and the rear flange may be oriented substantially parallel to the upper surface 64 of the supporting portion when the supporting portion is in the storage position. The rear flange 62 may extend along the rear periphery 67 of the upper surface between the opposite side edges. The front flange 63 may extend along the front periphery of the upper surface of the work platform. The front flange 63 may be oriented substantially perpendicular to the upper surface, and may include a return 69 such that the front flange forms an elongated channel.

The work platform 60 may be comprised of various other materials common with work benches, such as but not limited to wood, plastic, or metal.

G. Support Brackets.

Likewise, the support brackets 70 of the optional embodiments may have similar configurations and constructions the support brackets of the shelf embodiment, and thus may have a substantially horizontal first portion 71 for supporting a bottom surface of the supporting portion 61 of the work platform 60 and a substantially vertical second portion 72 for orienting substantially parallel to the wall supporting surface. The rear end of the vertical portion 72 may be pivotally connected to the wall supporting surface via a hinge 74 thus allowing the support brackets 70 to fold or pivot between an orientation substantially perpendicular to the wall supporting surface in an in-use or usage position and an orientation substantially parallel to the wall supporting surface in a collapsed or non use or storage position. It will be appreciated that the brackets may be folded inwards towards each other or outwards away from each other and temporarily secured in the parallel or perpendicular orientations via various types of locking structures.

In some embodiments, an optional cross beam 76 may be employed that is mounted or mountable on at least two of the support brackets 30 to span the support brackets. The optional cross beam 76 has opposite end portions which are each mountable to one of the spaced support brackets. The cross beam 76 may be mounted on the first portions 31 of the support brackets, and may be spaced from the second portions 32 so that when the second portions are mounted on the substantially vertical surface, the cross beam is likewise spaced from the vertical surface. In some embodiments, the cross beam is mounted on the outboard ends of the first portions. Use of the cross beam 76 may allow the support brackets so support items without need for the shelf platform or work platform.

Additionally, in optional embodiments, auxiliary or supplemental leg supports may be mounted, removably or permanently, to the underside of the work platform to contact a floor surface below the platform to provide additional load bearing capacity and provide additional support against hard impacts borne by the shelf platform or work platform.

In optional embodiments, the rear flange may be extended further upwardly from the supporting portion into an extended flange 78, and a shelf extension 79 may be formed on the extended flange 78 that extends forwardly and generally parallel to the supporting portion. A forward lip 80 may be formed on a forward extent of the shelf extension and extends downwardly (or optionally upwardly) in an orientation that is generally parallel to the extended rear flange.

H. Operation of Present Invention.

In use, the support brackets 30 may be mounted a predetermined distance apart, preferably a distance which places each support bracket 30 near an opposing longitudinal end of the shelf platform 20. The second portions of the support brackets 30 may be fastened to one or more studs located within the wall supporting surface and are made level. The shelf platform may then be placed upon the horizontal first portions 31 of the support brackets 30 so the rear flange 22 is positioned against the wall supporting surface and the front flange 23 extends over the outer ends of the horizontal portions 31 of the support brackets 30.

The shelf platform 20 may be affixed to the horizontal first portions 31 as needed using rivets, etc. and/or the rear flange 22 may be affixed to the wall supporting surface. FIG. 2 shows a plurality of rivets extending through the shelf platform 20 that subsequently extend into openings (not shown) of the first portion 31 of the support brackets 30. A desired number of hooks 50 may then be slid onto the mounting rail 40 and the ends of the mounting rail 40 are affixed to the vertical second portions 32 of the support brackets 30. The hooks 50 may now be slidably adjusted as needed. The work bench embodiment includes structure that allows the work platform 60 and the support brackets 70 to be folded to a usage position or to a storage position as needed thus allowing for a maximization of available work space.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

It should be appreciated from the foregoing description that, except when mutually exclusive, the features of the various embodiments described herein may be combined with features of other embodiments as desired while remaining within the intended scope of the disclosure.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

We claim:

1. A shelving system for attaching to a substantially vertical surface, the system comprising:

at least a pair of support brackets for mounting on the substantially vertical surface, each of the support brackets having a first horizontal portion and a second vertical portion, each of the first and second portions having inboard ends and outboard ends, the respective inboard ends of the first and second portions of a support bracket being permanently united together;

a shelf platform for being supported by two or more of the support brackets, the shelf platform comprising:

a supporting portion having a substantially planar upper surface with a front periphery and a rear periphery;

a rear flange extending along the rear periphery of the upper surface of the supporting portion for positioning adjacent to the substantially vertical surface when the shelf platform is mounted on the support brackets mounted on the substantially vertical surface, the rear flange being oriented substantially perpendicular to the upper surface of the shelf platform;

a front flange extending along the front periphery of the upper surface of the supporting portion, the front flange being oriented substantially perpendicular to the upper surface for extending over an outboard end of the second portion of the support brackets when the shelf platform is mounted on the support brackets;

wherein the shelf platform is configured to be supported by the first portions of the support brackets when the second portions of the support brackets extend upwardly from the shelf platform and when the second portions extend downwardly from the shelf platform further comprising a pass-through opening in said supporting portion wherein said pass-through opening is configured to allow the support brackets to extend through the shelf platform to suspend the shelf from a higher location on the substantially vertical surface, and the pass through opening permits the support bracket to be mounted on the substantially vertical surface at a location that is relatively above the supporting portion with the bracket extending through the opening to a position below the supporting portion so that the shelf platform is configured to rest upon the second portion of the bracket.

2. The system of claim 1 wherein the first and second portions of the support brackets are configured so that the shelf brackets are substantially L-shaped.

3. The system of claim 1 wherein the first and second portions of the support brackets are connected only at the inboard ends thereof such that space between the first and second portions are free of connecting structure.

4. The system of claim 1 wherein the first portion is oriented generally perpendicular to the second portion such that the second portion is oriented substantially horizontally when the first portion is oriented substantially vertically.

5. The system of claim 1 wherein the front flange of the shelf platform includes a return such that the front flange forms an elongated channel for receiving the outboard ends of the second portion of the support brackets.

6. The system of claim 1 additionally comprising an elongated mounting rail mounted on the support brackets, the mounting rail having opposite ends and a length defined between the ends; and at least one hook removably mountable on the mounting rail, the at least one hook having an inner end and an outer end, the at least one hook having a mounting portion toward the inner end and a support arm portion toward the outer end, the mounting portion defining an opening configured for receiving a portion of the mounting rail to mount the hook thereon and permitting the at least one hook to slide along at least a portion of the length of the mounting rail.

7. The system of claim 6 wherein the opening of the at least one hook is formed by an edge; wherein the at least one hook further comprises:

a stabilizer tab portion extending from the mounting portion and being positioned adjacent to the opening to extend along and closely adjacent to a portion of the mounting rail when the rail extends through the opening.

8. The system of claim 6 wherein the opening in the mounting portion has a shape and size configured to restrict the at least one hook against rotation with respect to the mounting rail when the rail extends through the opening.

9. The system of claim 6 wherein the mounting rail has a substantially uniform cross sectional exterior shape along at least a portion of the length of the mounting rail to permit sliding of the at least one hook along the portion of the length of the mounting rail.

* * * * *